United States Patent [19]

Gill, Jr. et al.

[11] Patent Number: 4,944,119

[45] Date of Patent: Jul. 31, 1990

[54] APPARATUS FOR TRANSPORTING WAFER TO AND FROM POLISHING HEAD

[75] Inventors: Gerald L. Gill, Jr., Phoenix; Thomas C. Hyde, Chandler, both of Ariz.

[73] Assignee: Westech Systems, Inc., Phoenix, Ariz.

[21] Appl. No.: 208,685

[22] Filed: Jun. 20, 1988

[51] Int. Cl.[5] ..... B24B 41/06

[52] U.S. Cl. ..... 51/215 R; 51/277; 51/283 R

[58] Field of Search ..... 51/215 R, 215 CP, 277, 51/283 R, 131.1, 131.2, 131.3, 131.4, 131.5

[56] References Cited

U.S. PATENT DOCUMENTS 4,811,522 3/1989 Gill, Jr. ..... 51/131.4

4,811,523 3/1989 Schmitz et al. ..... 51/277

*Primary Examiner*—Robert Rose

*Attorney, Agent, or Firm*—Tod R. Nissle

[57] ABSTRACT

Apparatus for transporting a wafer into position against the pressure head of apparatus for polishing the wafer. The transport apparatus includes a dolly for positioning a wafer over a transport head assembly. The transport head assembly removes the wafer from the dolly and positions the wafer against the pressure head. When the transport head assembly removes the wafer from the dolly and positions the wafer against the pressure head, the transport head assembly only contacts the wafer at selected points at the periphery of the wafer.

8 Claims, 11 Drawing Sheets

APPARATUS FOR TRANSPORTING WAFER TO AND FROM POLISHING HEAD

This invention relates to polishing apparatus.

More particularly, the invention relates to apparatus for polishing a side of a thin, flat wafer of a semiconductor material, the apparatus including a polishing head which holds the wafer against a wetted polishing surface under pressure, and which rotates and oscillates the wafer over the polishing surface.

In a further respect, the invention relates to apparatus of the type described in which the polishing head can readily "float" and change orientation to rapidly respond to and compensate for minor irregularities in the polishing surface.

In another respect, the invention relates to apparatus of the type described in which the pressure of the polishing head against the semiconductor wafer can be finely adjusted in small increments to facilitate control of the maginitude of the force pressing the wafer against the polishing surface.

In still a further respect, the invention relates to apparatus of the type described in which the downward force holding the wafer against the polishing surface under pressure is transmitted to the wafer through an edge contact in the polishing head, the application of force through the edge contact more uniformly distributing over the wafer-polishing surface interface the pressure applied by the polishing head.

Apparatus for polishing thin, flat semiconductor wafers is well known in the art. See, for example, U.S. Pat. Nos. 3,841,031 to Walsh and 4,193,226 to Gill, Jr. et al. Such apparatus includes a polishing head which carries a semiconductor wafer and presses the wafer downwardly against a wetted polishing surface. The polishing head rotates and oscillates the wafer over the polishing surface. The polishing head is forced downwardly toward the polishing surface by an air cylinder or a comparable mechanism. A particular problem encountered in the use of such apparatus is maintaining a uniform downward pressure on the semiconductor wafer while the wafer travels over the polishing surface. The air cylinder used to force the polishing head and wafer against the polishing surface is not rigid and, like a shock absorber in an automobile, gives so that the polishing head can, to a certain extent, float and compensate for irregularities in the polishing surface. However, frictional forces in the air cylinder tend to resist displacement of the polishing head which would compensate for minor variations in the polishing surface. Such minor variations in the polishing surface, if not compensated for, can form undulations on the polished surface of the semiconductor wafer. This is particularly the case for soft semiconductor materials like gallium arsenide.

While it is desirable to have a polishing head which is sensitive to variation in the polishing surface, it is also desirable at the beginning of a polishing operation to be able to apply a pressure to the semiconductor wafer which is different than the pressure applied to the wafer at the end of the polishing operation. As a result, throughout the polishing operation it is advantageous to be able gradually continuously adjust in small increments the pressure forcing the semiconductor wafer against the polishing surface.

Accordingly, it would be highly desirable to provide improved semiconductor polishing apparatus of the general type described which would permit the accurate application in small increments of pressure to a semiconductor wafer and which would provide a polishing head which would "float" and quickly react to and compensate or minor variations in the contour of a polishing surface contacting the semiconductor wafer.

Therefore, it is a principal object of the invention to provide improved apparatus for polishing a surface of a flat, semiconductor wafer.

Another object of the invention is to provide improved semiconductor wafer polishing apparatus which includes a polishing head for carrying a semiconductor wafer and rotating and oscillating the wafer under pressure over a polishing surface.

A further object of the invention is to provide an improved polishing apparatus of the type described in which the pressure of the polishing head can be adjusted in small increments and in which the polishing head "floats" on a polishing surface and is sensitive to and quickly vertically alters position in response to variations in the contour of the polishing surface.

Still another object of the instant invention is to provide improved semiconductor wafer polishing apparatus of the type described in which the polishing head more uniformly distributes downward pressure over the entire semiconductor wafer-polishing surface interface.

These and other, further and more specific objects and advantages of the invention will be apparent to those skilled in the art from the following detailed description thereof, taken in conjunction with the drawings, in which:

FIG. 1. is a front elevation view of polishing apparatus constructed in accordance with the principles of the invention;

Figure 1:
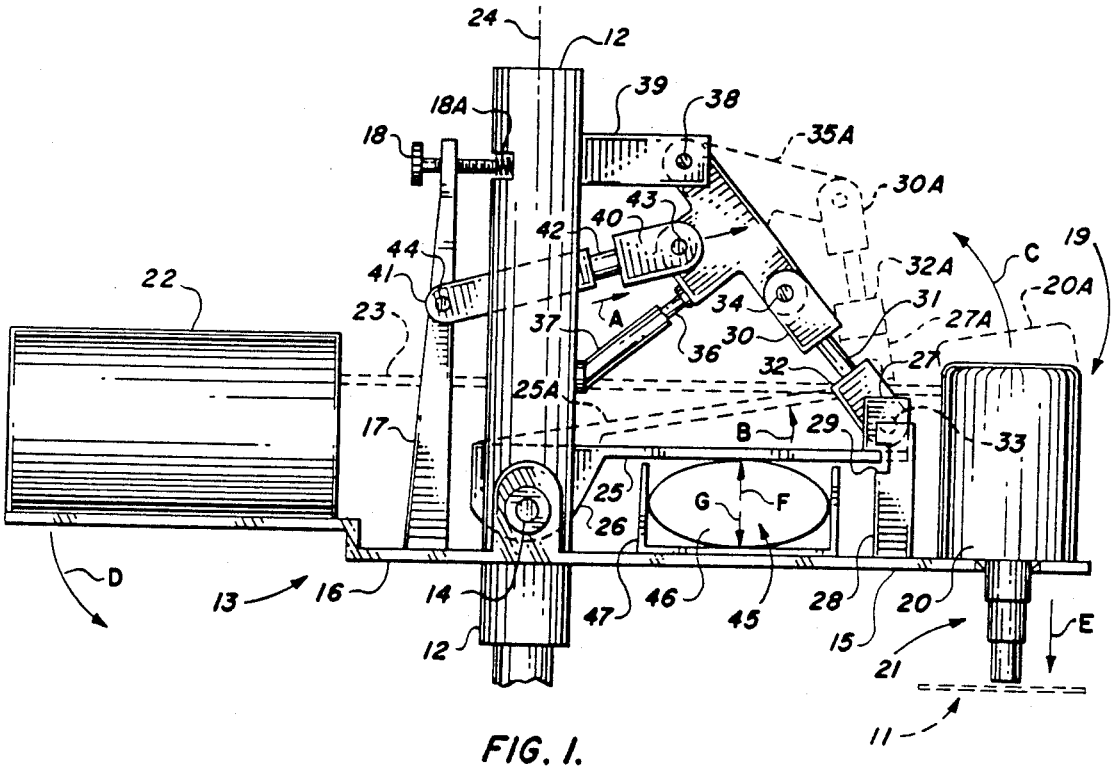

Briefly, in accordance with my invention, I provide apparatus for polishing a surface of a thin, flat wafer of a semiconductor material. The apparatus includes at least one station having a substantially flat polishing surface; a frame; elongate carrier means mounted on the frame to pivot about a point thereon and including a first portion extending outwardly to one side of the pivot point, a second portion extending to the other side of the pivot point, and a floating pressure head carried on the first end of the carrier means and having a lower portion for maintaining the wafer in contact with the head; resilient expandable means intermediate and contacting the frame and the elongate carrier means and expanding against the carrier means between at least two operative positions, a first operative position causing the carrier means to apply a first pressure to the floating head to hold the wafer in contact with the polishing surface, and a second operative position causing the carrier means to apply to the floating head and wafer a second pressure different than the first pressure; and, counterweight means mounted on the second portion of the carrier means such that the counterweight means and the second portion of the carrier means generally counterbalance the first portion of the carrier means and the pressure head. At least one of the polishing surface and the pressure head is rotatable.

In another embodiment of my invention, I provide improved apparatus for polishing a surface of a thin, flat wafer of a semiconductor material. The apparatus includes at least one station having a substantially flat polishing surface; a frame; elongate carrier means pivotally mounted on the frame; and, a floating pressure head mounted on the carrier means over the polishing surface. The pressure head includes a base including a lower portion for maintaining the wafer in contact therewith and against the polishing surface and includes an upper portion having a planar surface area; a force transmitting member connected to the base and having an upper planar surface, a lower surface, and edge means at the periphery of the lower surface and contacting the planar surface area of the base; and, a rod mounted on the carrier means and including an upper end and a lower planar end contacting the upper planar surface of the force transmitting member. The lower planar end of the rod includes a periphery and presses against the upper planar surface of the force transmitting member. The pressure of the rod against the upper planar surface of the force transmitting member is transmitted to the base through the edge means to press the wafer against the polishing surface. The base and force transmitting member move between at least two operative positions with respect to the lower planar end of the rod, a first operative position with the lower planar end of the rod contacting and generally parallel to the upper planar surface of the force transmitting member; and, a second operative position with respect to the lower planar end of the rod such that the power planar end of the rod is canted away from and only contacts the upper planar surface at points on the periphery of the lower planar end. At least one of the polishing surface and the pressure head rotate.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 7 illustrate polishing apparatus constructed in accordance with the principles of the invention and including a polishing surface 11, frame 12, and carrier means 13 attached to frame 12 at pivot point 14. Carrier means 13 includes first portion 15 extending to one side of pivot point 14 and second portion 16 extending to the other side of pivot point 14. Second portion 16 includes upwardly extending substantially rigid arm 17. Externally threaded set screw 18 turns through an internally threaded aperture in arm 17 against resilient compressed spring 18A. Pressure head assembly 19 is mounted on portion 15 of the carrier means 15 and includes housing 20 and rotatable rod 21 extending downwardly from carrier means 15. The upper end of rod 21 extends into housing 20 and is operatively associated with means for transmitting motive power to rod 21. Motive power for rotating rod 21 is provided by counterbalance or motor 22 carried on portion 16 of carrier means 15. Dashed lines 23 represents gearing or other means used to transmit motive power from motor 22 to the means in housing 20 which supply motive power to rod 21. Means (not shown) can also be supplied to rotate frame 12 about axis 24 such that rod 21 and a pressure head carried on rod 21 can be laterally oscillated over polishing surface 11. Polishing surface 11 can be mounted on frame 12 or can be supported on framework independent of frame 12.

Arm 25 is fixedly connected to and outwardly extends from cam-shaped plate 26. Plate 26 is carried on the back of frame 12 at pivot point 14. Rectangular panel 27 is connected to and upwardly extends from arm 25. Panel 27 is positioned behind upwardly extending finger 28 of portion 15. U-shaped mouth 29 in finger 28 receives and bounds the end of arm 25. Links 30 and 32 are interconnected by arm 31. Link 32 is pivotally connected 33 to panel 27. Link 30 is pivotally connected 34 to T-shaped panel member 35. Stop 36 is fixedly connected to member 35 and in FIG. 1 is shown resting against stop 37 fixedly connected to frame 12. Member 35 is pivotally connected 38 to arm 39 fixedly attached to and extending outwardly from frame 12. Plunger 42 of hydraulic piston 41 is fixedly attached to link 40. Link 40 is pivotally attached 43 to member 35. Hydraulic piston 41 is pivotally attached 44 to arm 17. Hydraulic fluid or any other appropriate fluid can be utilized to operate piston 41. The hydraulic or pneumatic lines leading to piston 41 have been omitted from FIG. 1 for the sake of clarity. When hydraulic piston 41 is operated to outwardly displace plunger 42 in the direction of arrow A, member 35, links 30 and 32, and panel 27 are displaced in the manner indicated by dashed lines 35A, 30A, 32A and 27A in FIG. 1, and arm 25 moves upwardly in the direction of arrow B to the position indicated by dashed lines 25A. The outer end of arm 25 contacts the upper part of mouth 29 when arm 25 moves in the direction of arrow B. When the outer end of arm 25 contacts mouth 28, the carrier means is pivoted about pin 14, housing 29 moves upwardly in the direction of arrow C (as also indicated by dashed lines 20A), and portion 16 moves downwardly in the direction of arrow D. Accordingly, extending plunger 42 in the direction of arrow A causes pressure head assembly 19 to be upwardly displaced away from polishing surface 11. Means for rotating or oscillating polishing surface 11 are well known in the art and are omitted from FIG. 1 for the sake of clarity.

Figure 2A:
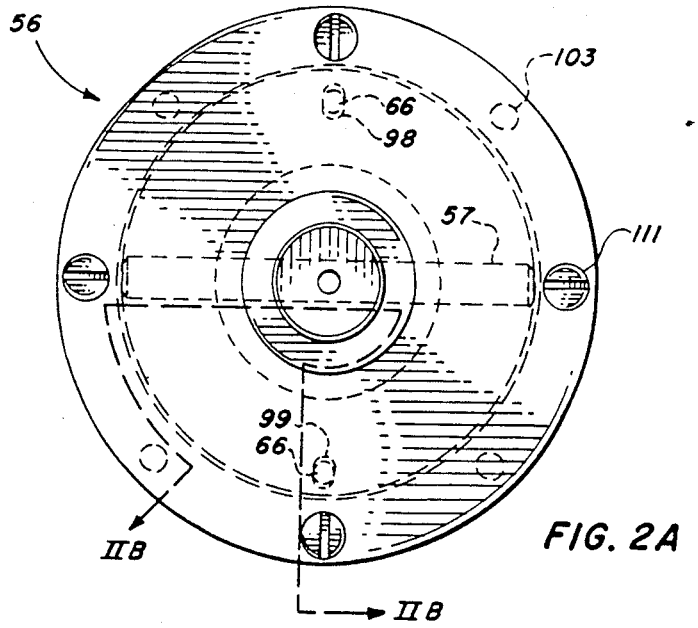
FIG. 2A is a top view of the polishing head of the apparatus of FIG. 1.
Figure 2B:
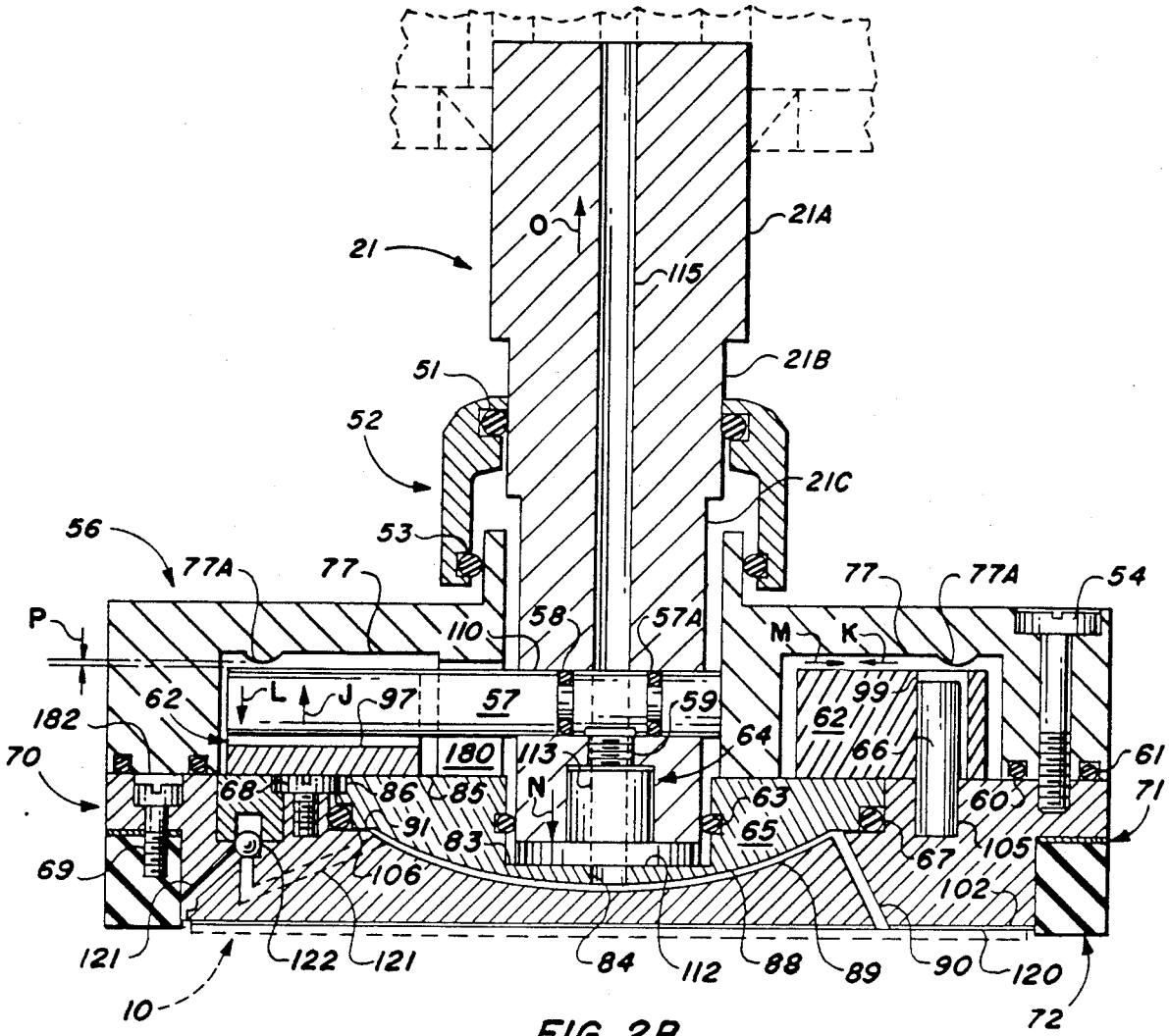
FIG. 2B is a section view of the polishing head of FIG. 2A taken along section line 2B–2B thereof and further illustrating interior construction details thereof.
Figure 3:
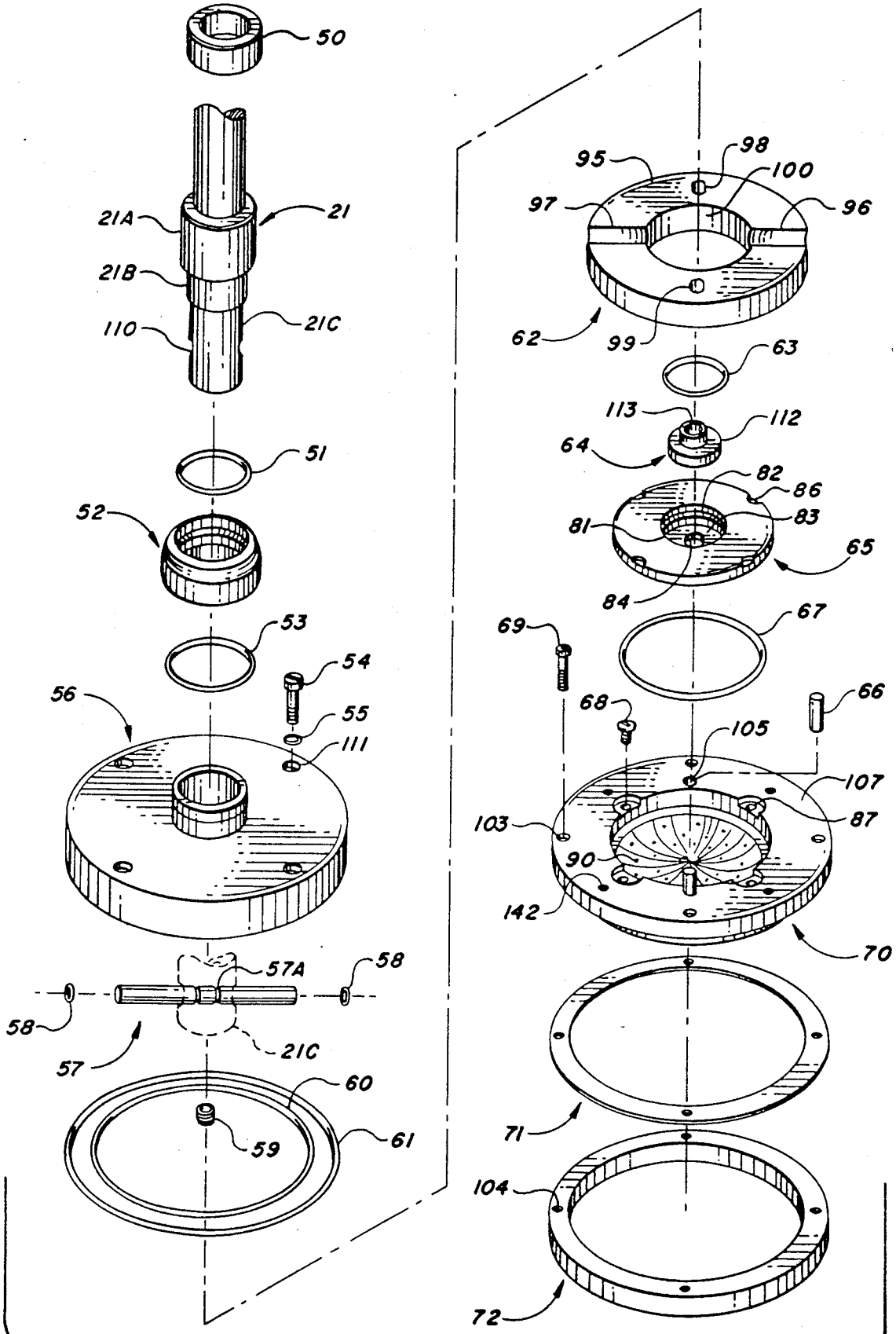
FIG. 3 is an exploded assembly view illustrating the polishing head of FIGS. 2A and 2B.

When carrier means 13 is generally horizontally disposed in the manner illustrated in FIG. 1, resilient inflatable/deflatable bladder means 45 is used to increase or decrease the downward pressure E on the polishing head carried on rod 21. The polishing head carried on rod 21 is illustrated in FIGS. 2A, 2B and 3. Bladder means 45 includes bladder 46 and U-shaped housing 47 for bladder 46. In FIG. 1 bladder 46 has not been inflated sufficiently to exert a force F against arm 25 and a force G against portion 15 of carrier means 13. The means for inflating and deflating bladder 46 with air or another fluid is well known in the art and has, for the sake of clarity, been omitted from FIG. 1. When resilient expandable bladder 46 is inflated, it expands outwardly against arm 25 and portion 15 of carrier means 13. The force F generated by the expanded bladder 46 against arm 25 does not cause arm 25 to move because member 35 and links 30 and 32 maintain arm 25 in fixed position. The force G generated against portion 15 by expanded bladder 46 increases the downward force E on the polishing head carried by rod 21 and may cause portion 15 to slightly move downwardly due to the increased compressive pressure on the wafer carried by the polishing head and on polishing surface 11. Before bladder 46 is expanded to increase the downward force E on the polishing head, the weight of the counterbalance 22 is normally adjusted such that it, along with portion 16 generally offsets the weight of arm portion 15 and pressure head assembly 19; provided, however, that the weight of counterbalance 22 and portion 16 is slightly less than the weight of portion 15 and pressure head assembly 19 such that there is a slight downward force or bias E acting on the polishing head. As would be appreciated by those of skill in the art, bladder 46 can be inflated and deflated to increase, and then decrease, the force E acting on the polishing head in small increments. Set screw 18 can also be turned toward or away from spring 18A and frame 12 to decrease or increase, respectively, the downward force E on the polishing head.

The polishing head normally carried on rod 21 is illustrated in FIGS. 2A, 2B and 3 and includes ring 50, rod 21, O-ring 51, sleeve 52, O-ring 53, bolts 54, washers 55, cover 56, cylindrical rod 57 with circular grooves 57A, O-rings 58 for grooves 57A, O-rings 60 and 61 for grooves 73 and 74 in cover 56 (FIG. 4), threaded setscrew 59, retainer ring 62, O-ring 63, foot 64, force transmitting member 65, O-ring 67, base 70, screws 68 and 69, pins 66, spacer 71, and lip 72.

Figure 4:
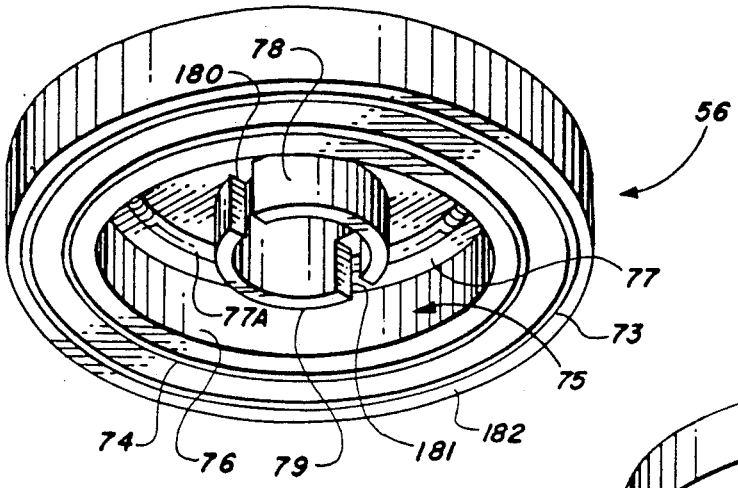
FIG. 4 is a perspective view further illustrating one of the components of the polishing head of FIG. 3.

As shown in FIG. 4, cover 56 includes indent 75 having cylindrical wall 76 and floor 77. Circular rim 77A is fixedly connected to and outwardly extends from floor 77. Generally semicircular wall portions 78 and 79 bound U-shaped slots 180 and 181. Circular groove 73 and 74 are formed in planar circular surface 182.

Force transmitting member 65 (FIG. 5) includes apertures 81 and 84, circular upper planar surfaces 83 and 85, and circular groove 82. Indents 86 receive a portion of the heads of screws 68 threaded into apertures 87 of base 70. Lower convex spherically shaped surface 88 of member 65 is spaced apart from and opposed to concave spherically shaped surface 89 of base 70. Circular planar surface 92 and 91 are parallel and interconnected by cylindrical surface 93. Surface 93 is generally perpendicular to surfaces 91 and 92 and is parallel to peripheral surface 94.

Figure 6:
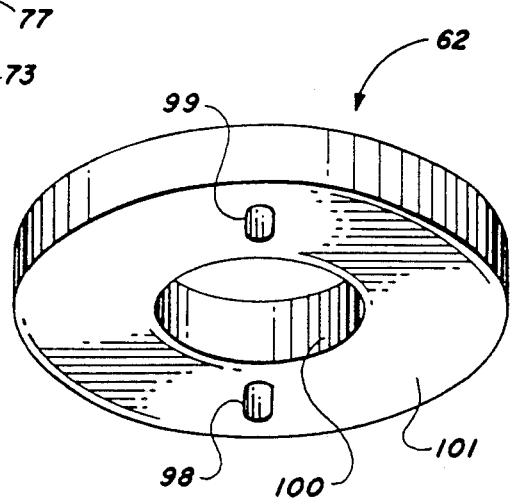
FIG. 6 is a perspective view further illustrating still another of the components of the polishing head of FIG. 3.
Figure 5:
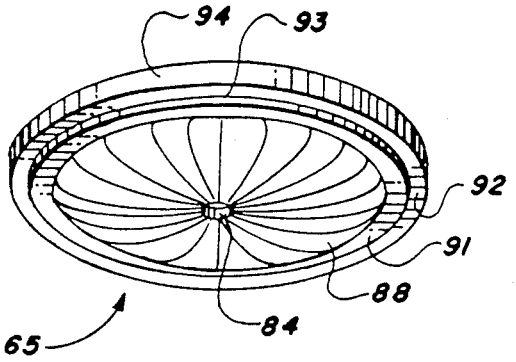
FIG. 5 is a perspective view further illustrating another of the components of the polishing head of FIG. 3.

In FIGS. 3 and 6, retainer ring 62 includes upper planar circular surface 95, U-shaped slots 96 and 97, and elongate apertures 98 and 99. Apertures 98 and 99 have parallel spaced apart side walls and semi-circular ends. Cylindrical aperture 100 extends through member 62 from upper surface 95 to lower planar circular surface 101.

Figure 7:
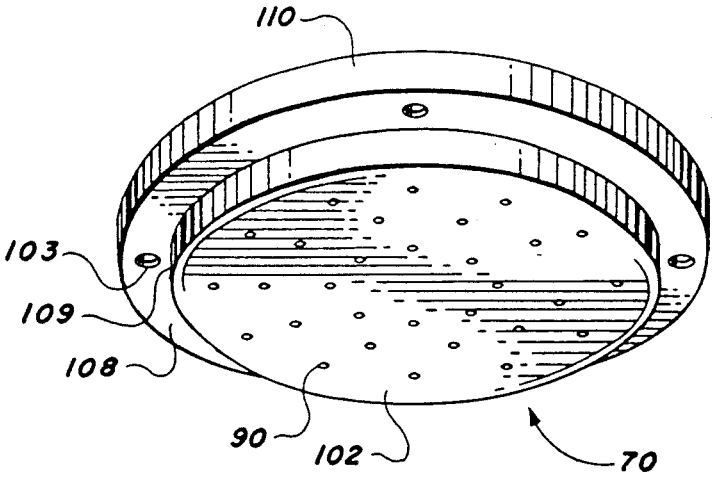
FIG. 7 is a perspective view of further illustrating yet another of the components of the polishing head of FIG. 3.

In FIGS. 3 and 7, base 70 includes apertures or perforations 90 extending from concave surface 89 to planar, circular lower surface 102. Apertures 103 slidably receive bolts 69. Bolts 69 thread into internally threaded apertures 104 of lip 72. Pins 66 are fixedly press fit in apertures 105. Circular planar surface 106 is parallel to circular planar surface 107, to surface 102, and to circular planar surface 108. Cylindrical surfaces 109 and 110 are parallel to one another and perpendicular to surface 102.

In FIG. 3, pin 57 is slidably received by aperture 110 formed through rod 21. Setscrew 59 secures pin 57 in aperture 110. Bolts 54 are slidably received by apertures 111 in cover 56 and are threaded into apertures 142 in base 70. Foot 64 includes lower circular planar surface 112. Aperture 113 is formed through foot 64.

As can be seen in FIG. 2B, lip 72 is attached to base 70 with screws 69. Circular lip or edge 91 of member 65 is tightened against planar surface 106 of base 70 with screws 68. Cover 56 is attached to base 70 with screws 54. Retainer ring 62, however, is mounted intermediate cover 56 and base 70 and is not connected to cover 56, member 65, base 70 or any other member of component of the polishing head of FIG. 2B. Consequently, retainer ring 62 can slide over surface 85 in the directions indicated by arrows M and K in FIG. 2B. In FIG. 3, arrows M and K would, if shown, lie along a line which lies in the horizontal plane passing through surface 95. The line would also pass through the center of the ends or mouths of apertures 98 and 99 opening at surface 95. In other words, arrows M and K are perpendicular to slots 96 and 97 and to pin 57. Pin 57 is slidably received by slots 96 and 97.

In FIG. 2B foot 64 rests on but is not connected to planar surface 83. Downward pressure N exerted on foot 64 by rod 21 forces planar surface 112 against surface 83 of member 65. If the downward pressure N by rod 21 is discontinued, and rod 21 is displaced in the direction of arrow O, rod 21 and pin 57 move upwardly away from surface 83 a short distance indicated by arrows P. Arrows P represent the distance pin 57 can slide upwardly through groove 96 and 97 before contacting and being stopped by circular rim 77A.

Figure 2C:
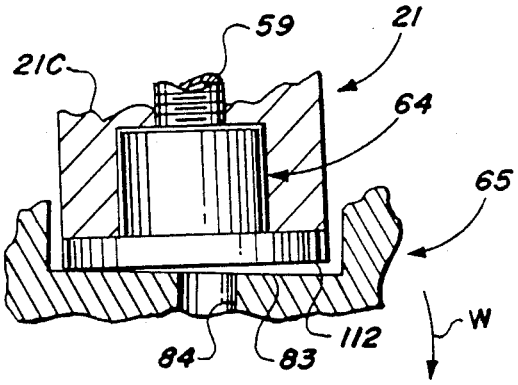
FIG. 2C is an enlarged view of a pressure imparting component of the polishing head of FIG. 2 illustrating the mode of operation thereof.
Figure 2D:
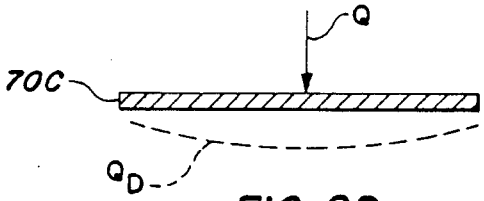
FIG. 2D is a simplified illustration of a polishing head illustrating the normal pressure distribution produced by application of a downward force to the head at a point centered in the polishing head.
Figure 2E:
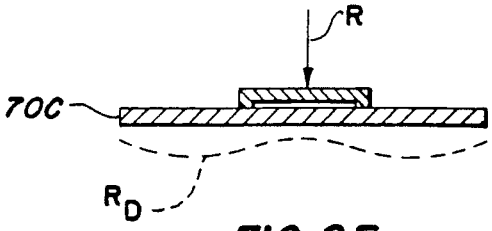
FIG. 2E is a simplified illustration of a polishing head illustrating the normal pressure distribution produced by application of a downward force at points intermediate the center and periphery of the polishing head.

When a semiconductor wafer, indicated by dashed lines 10 in FIG. 2B, is maintained under pressure against polishing surface 11 by the polishing head, rod 21 normally maintains a generally fixed vertical orientation. Cover 56, member 65 and base 70 of the polishing head can, in compensating for irregularities in the polishing surface, simultaneously cant with respect to rod 21 and member 64. This canting is illustrated in exaggerated fashion in FIG. 2C. As illustrated in FIG. 2C, when base 70 andd upper planar surface 83 cant away from planar surface 112 in the direction indicated by arrows W, points on the periphery of surface 112 maintain contact with surface 83. When member 65 and base 70 cant respect to rod 21 and member 64, retainer ring 62 can cant with base 70 and the vertical sides of slots 96 and 97 can slide over pin 57. Such tilting of retainer ring 62 with respect to pin 57 is possible because while pin 57 slidably contacts the vertical sides of slots 96 and 97, pin 57 is normally positioned in slots 96 and 97 in a position spaced above the bottom surfaces of slots 96 and 97. The normal position of pin 57 spaced above the bottoms of slots 96 and 97 is illustrated in FIG. 2B.

Pins 66 each slidably contact the parallel opposed flat planar sides of an aperture 98 or 99. Apertures 98 and 99 are longer than the diameter of pins 66 (see FIG. 2B), which permits ring 62 to slide back and forth or to tilt up and down short distance with respect to pins 66.

The downward force N applied to surface 83 by rod 21 and member 64 is transmitted by member 65 to base 70 through circular edge surface 91 contacting circular planar surface 106 of base 70. Transmitting force N through circular edge surface 91 more uniformly distributes force N over the wafer 10—polishing surface 11 interface. This uniform distribution of force N is explained with reference to FIGS. 2D and 2E. When, in FIG. 2D, a force Q is applied to the center point of a polishing head base 70C, the distribution of force Q along the bottom of the base can be approximated by dashed line $Q_D$. As indicated by $Q_D$, the resulting forces along the bottom of base 70C are greatest at the center of the base and decrease as points nearer the periphery of the base 70C are selected. When in FIG. 2E, a force R is applied to a force transmitting member with edge contacts intermediate the periphery and center of base 70C, then the force distribution $R_D$ along the bottom of base 70C is more uniform. An additional virtue of the polishing head construction of FIGS. 2B and 3 is that it permits the interface between surfaces 112 and 83 to be positioned near the bottom surface 102 of base 70, producing a more stable polishing head.

As illustrated in FIG. 2B, a thin circular piece of Rodel "40 film" backing material is attached to surface 102 of base 70. The poromeric "40 film" is attached by compressing it between a hot smooth metallic surface and surface 102. Compression of the "40 film" ordinarily reduces the original thickness of the film by 40% to 60% and makes the film relatively stiff. The heat compression of the "40 film" also produces a smooth outer surface on the film for contacting wafer 10. "40film" is produced by Rodel Products Corporation of 9495 East San Salvador Drive, Scottsdale, Ariz. 85258.

As noted earlier, apertures 90 are formed through base 70. These apertures also extend through layer 120 of the Rodel "40 film". Liquid is directed under pressue through apertures 115 (in rod 21), 113 and 84 into the space between surfaces 88 and 89. The liquid then flows through apertures 90 to wet a wafer being placed against the "40 film". When semiconductor wafer 10 is contacted with layer 120, suction can be applied to apertures 115, 113, 84, and accordingly, 90, to maintain wafer 10 in contact with layer 120. Check valve 122 permits water to flow through apertures 115, 113, 84 and 121 to the periphery of wafer 10. Valve 122 closes when suction is applied to aperture 115. This suction would, is valve 122 did not close, tend to draw fluid in the direction of arrow O. When, as earlier described, fluid is directed through aperture 115 under pressure to wet a wafer, the fluid flows in a direction of travel opposite the direction indicated by arrow O.

In use, a polishing head is attached to rod 21 in FIG. 1. A wafer 10 is interposed between the polishing head and surface 11. The counterbalance 22 is adjusted such that the pressure head assembly 19 and portion 15 are slightly heavier than counterbalance 22 and portion 16. This biasing of the pressure head assembly genetly holds wafer 10 under pressure against polishing surface 11. Rod 21 is rotated and/or oscillated and polishing surface 11 is rotated and/or oscillated. Bladder 46 is expanded and contracted as desired to alter the magnitude of downward force E on wafer 10. Set screw 18 and spring 18A are used as desired to finely adjust the magnitude of force E. During polishing of wafer 10, base 70 of the polishing head cants in the manner earlier described to compensate for variations in polishing surface 11. Bladder 26 also functions as a very sensitive shock absorber to absorb and soften any minor vertical displacement of the polishing head during polishing of wafer 10.

The polishing apparatus of the invention can be utilized to polish wafers of glass, ceramics, plastics, and other materials. One or both of surfaces 102 and 11 can be concave, convex or otherwiise contoured to polish lens-shaped surfaces or other contoured surfaces on a wafer of material.

Figure 8:
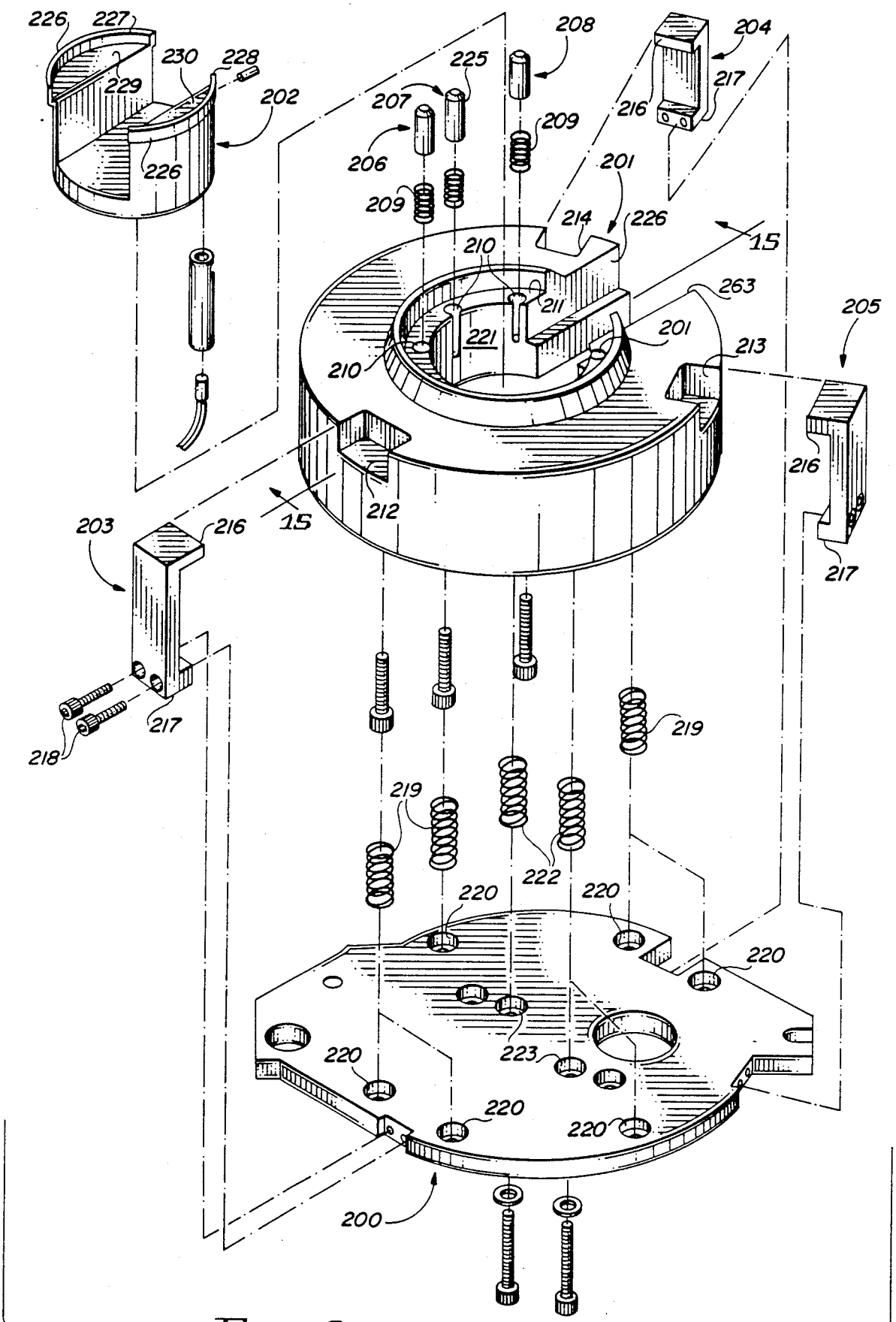
FIG. 8 is an exploded assembly view of a wafer transport head assembly utilized to remove a wafer from a dolly and transport the wafer to the polishing head.

FIGS. 8 to 15 depict apparatus for transporting a wafer to and from layer 120 of the pressure head of FIG. 2B. FIG. 8 illustrates a transport head assembly including a base 200, alignment cup 201, support piston 202, legs 203 to 205, and pins 206 to 208. Apertures 210 open at and extend downwardly fro circular rim surface 211. Apertures 210 are generally formed at equal intervals around rim surface 21. Although only four apertures 210 are visible in FIG. 8, there are actually six apertures 210 formed in rim surface 211. Three of the pins 206 to 208 and springs 209 are ommitted from FIG. 8 for the sake of clarity. Each aperture 210 is, however, intended to be provided with a spring 209 and pin 206 to 208. Each pin 206 to 208 is identical in shape and dimension. Indents 212 to 214 each receive the upper arm 216 of a leg 203 to 205. The bottom arm 217 of each leg 203 to 205 is attached to base 200 with bolts 218. Legs 203 to 205 press alignment cup 201 against springs 219. The lower end of each spring 219 rests in a detent 220 formed in base 200. The upper end of each spring 219 rests in a similar detent (not visible) formed in cup 201. Support piston 202 is slidably received by cylindrical aperture 221 formed in cup 201. Springs 222 provide support for piston 202. The lower ends of springs 222 are received by detents 223. The upper ends of springs 222 are received by similar detents 224 formed in the bottom of piston 202. The upper tip 225 of each pin 206 to 208 is tapered in a truncated conical shape.

Piston 202 includes cylindrical outer surfaces 226 which slidably contact surface 221. Arcuate lips or support surfaces 227 and 228 are above planar floor portions 229 and 230.

Figure 13:
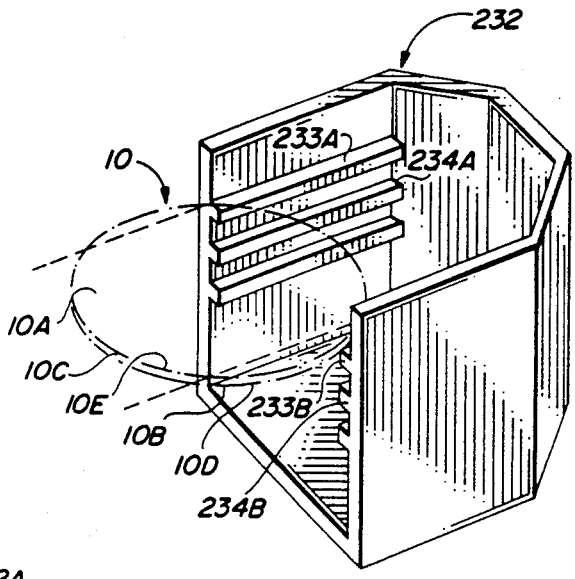
FIG. 13 is a perspective view of a wafer cassette.

The wafer storage cassette 232 shown in FIG. 13 includes a plurality of opposed, spaced apart pairs 233A, 233B and 234A, 234B of support ledges. Each ledge pair supports selected peripheral edge portions of a wafer 10. Wafer 10 includes spaced apart top 10AA and bottom 10B surfaces. Surfaces 10 and 10B each terminate at edge 10C.

The wafer dolly 236 is utilized to transport wafers from cassette 232 to the transport head assembly of FIG. 8. Dolly 236 includes rectangular base 237. Pin 238 is fixedly attached to base 237 and maintains roller 239 in position adjacent base 237. Elongate pin 240 is fixedly attached to base 237. Spring 241 is positioned around pin 240. Ends 242A and 242B of spring 241 bear against pin 243 fixedly attached to base 237. Spring 241 functions to bias dolly 236 so that roller 239 will travel along a track 244 (FIG. 10) in the manner described below. Tongue 245 of dolly 236 is connected to neck 246. Neck 246 is attached to base 237. Upper planar surface 248 of tongue 245 is bounded at either end by arcuate outwardly sloping or diverging surfaces 247 and 249. Surfaces 247 and 249 contact the lower linear circular portion 10D of edge 10C and prevent the bottom 10B of wafer 10 from contacting upper surface 248 of dolly 236.

Figure 10:
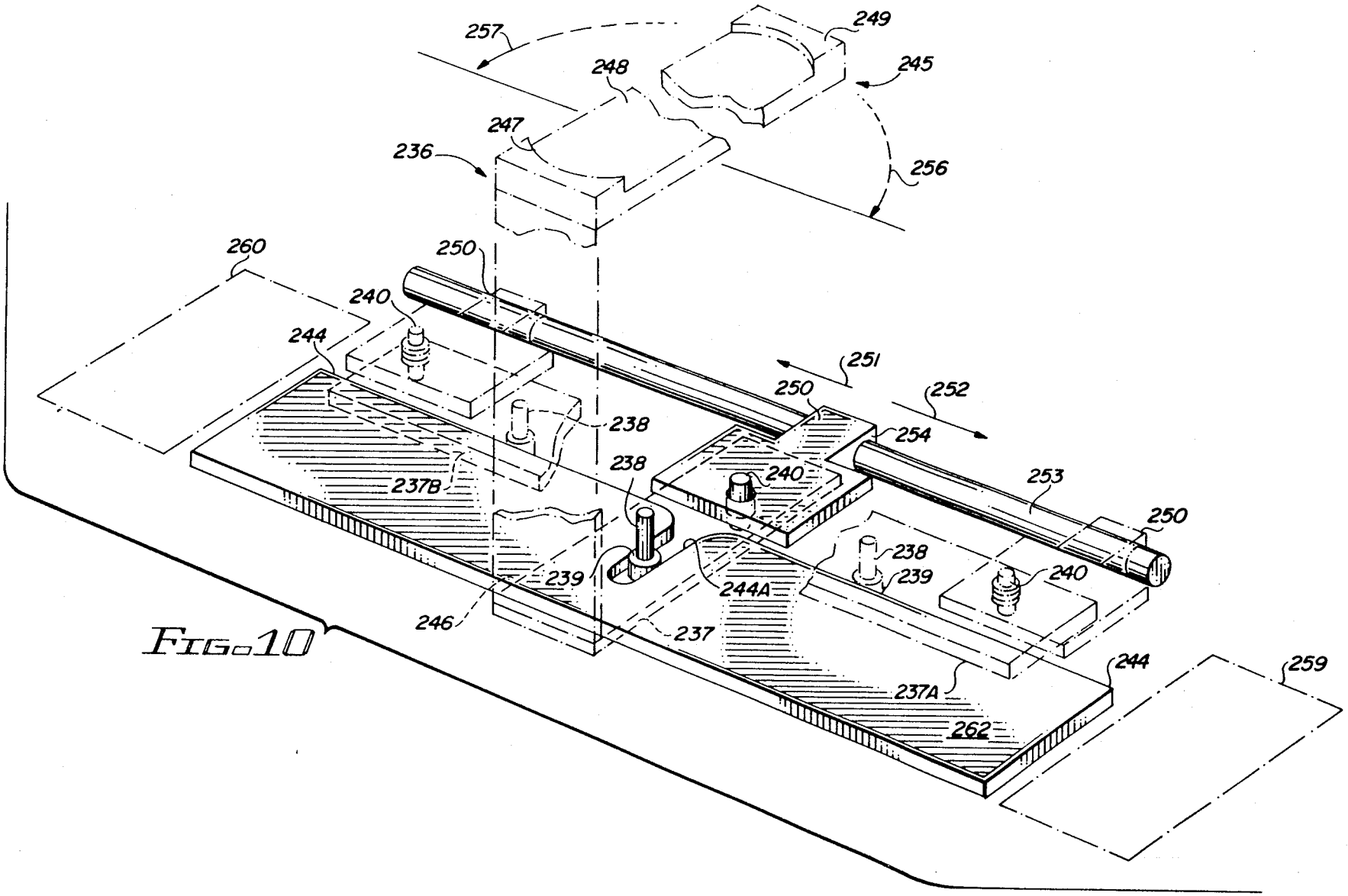
FIG. 10 is an assembly view of a wafer dolly and track utilized to transfer a wafer from a wafer cassette to the wafer trasnport head assembly.

The operation of wafer dolly 236 is explained with reference to FIG. 10. In FIG. 10, the tongue 245, neck 246 and base 237 of dolly 236 are shown in ghost outline for the sake of clarity. During operation, roller 239 of dolly 236 moves along edge or track 244 of plate 262. Track 244 is, except for a jog 244A at the center of the track, linear. Jog 244A enables the orientation of tongue 245 to be altered by 180 degrees. The lower portion of pin 240 is pivotally connected to plate 250. Motive power means (not shown) are provided for moving plate 250 in directions 251 and 252 along cylindrical rod 253. Cylindrical aperture 254 in plate 250 slidably moves along rod 253. When plate 250 is at the midpoint illustrated in FIG. 10, tongue 245 is in the orientation indicated by dashed lines 245. When plate 250 is moved in the direction of arrow 252, tongue 245, base 237, and neck 246 pivot 90° in the direction indicated by arrow 256. Consequently, base 237 assumes the orientation indicated by dashed lines 237A. Conversely, if plate 250 from the center position illustrated in FIG. 10 in the direction of arrow 251, the tongue 245, neck 246, and base 237 are rotated 90° in the direction of arrow 257 and base 237 assumes the orientation illustrated by dashed lines 237B. In FIG. 10 dashed lines 259 generally indicated the position of a wafer cassette 232 and of means for raising and lowering cassette 232. Dashed lines 260 generally indicate the location of the transport head assembly.

Figure 12:
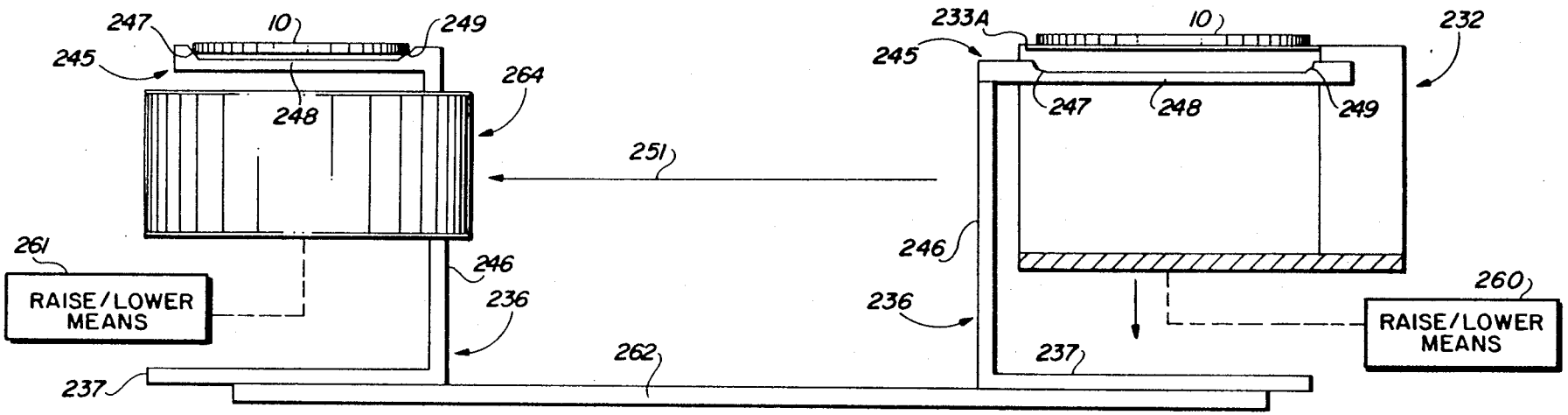
FIG. 12 is an elevation view illustrating use of the wafer dolly to transport a wafer from a wafer cassette to the wafer transport head assembly.
Figure 14:
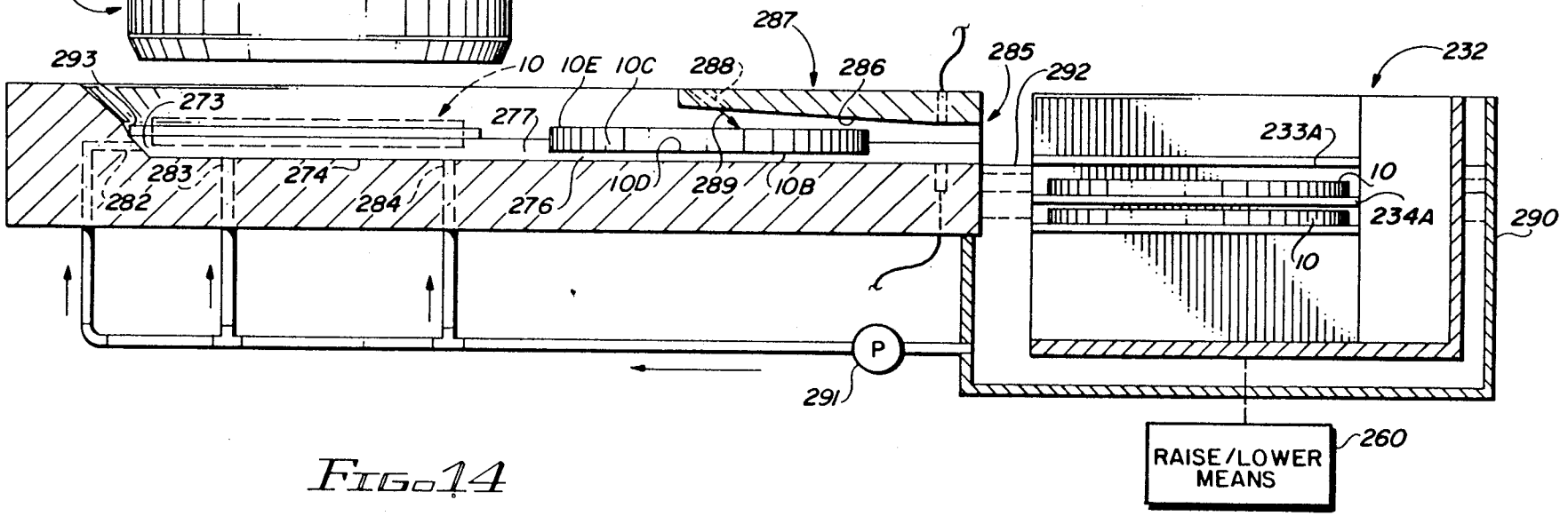
FIG. 14 is a section view illustrating operation of the wafer water track assembly to transport a wafer from the polishing head to a water cassette.

Operation of the wafer dolly 236 is further illustrated in FIG. 12. When plate 250 moves in the direction of arrow 252 (FIG. 10) such that the base of dolly 236 arrives at the position indicated by dashed lines 237A, the dolly 236 is in the position illustrated in the right hand portion of FIG. 12 with tongue 245 extending into cassette 232 beneath a wafer 10. Means 260 is operated to lower cassette 232 while tongue 245 remains in fixed position. Lowering cassette 232 causes portions of the peripheral edge portion 10D to contact arcuate outwardly sloped surfaces 247 and 249 to lift wafer 10 off of ledge pair 233B (not visible in FIG. 12) and 233A. After wafer 10 is so positioned on surfaces 247 and 249, plate 250 is moved in the direction of arrow 251 to move roller 239 along edge 44 through jog 44A and to a point where base 237 is in the position indicated by dashed lines 237B in FIG. 10. When the base is in the position indicated by dashed lines 237B, dolly 236 is in the position indicated by the left hand portion of FIG. 12 with tongue 245 above the transport head assembly 264. Once tongue 245 is positioned over transport head assembly 264, assembly 264 is operated in the manner described in FIGS. 15A to 15E to remove the wafer 10 from tongue 245 and position wafer 10 adjacent the pressure head.

Figure 15A:
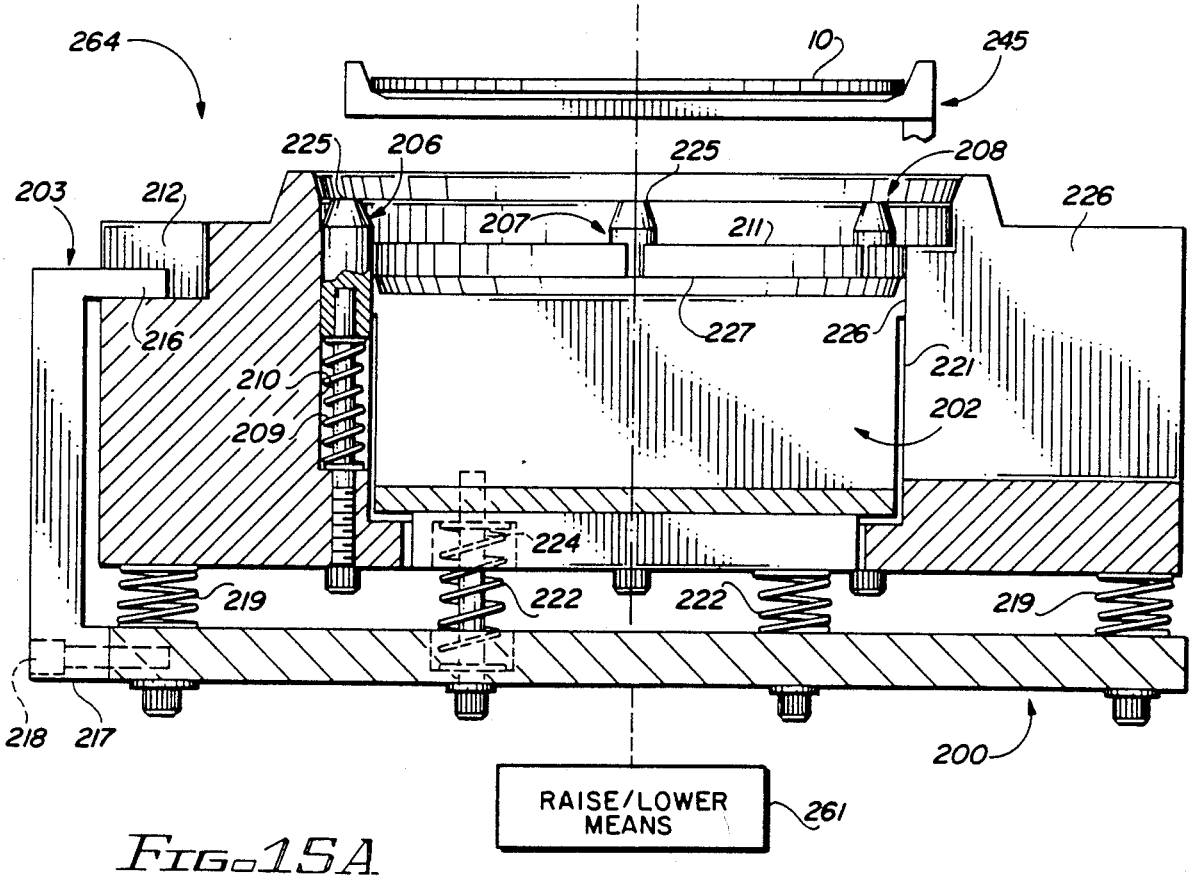
FIGS. 15A to 15E illustrate operation of the wafer transport head assembly to remove a wafer from the wafer dolly and position the wafer adjacent the polishing head.

In FIG. 15A, the transport head assembly 264 and tongue 245 are in the position illustrated in the left hand portion of FIG. 12.

Figure 11:
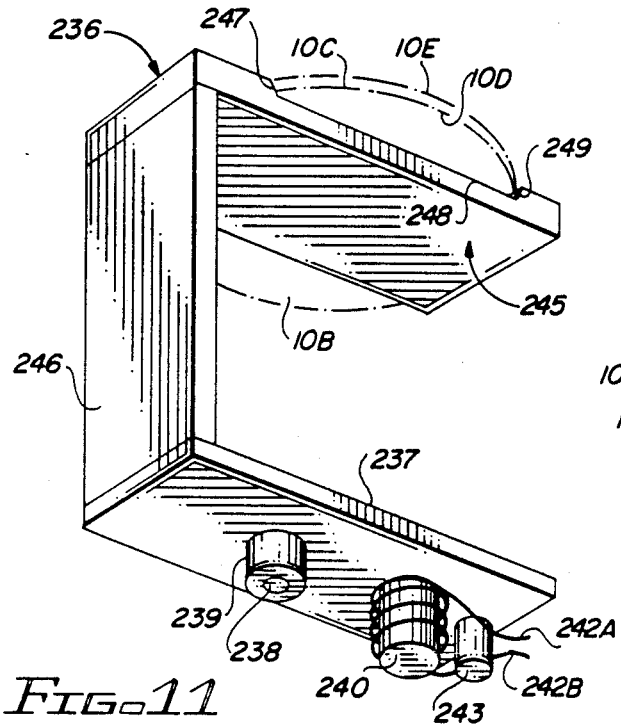
FIG. 11 is a perspective view of the wafer transport dolly.
Figure 15B:
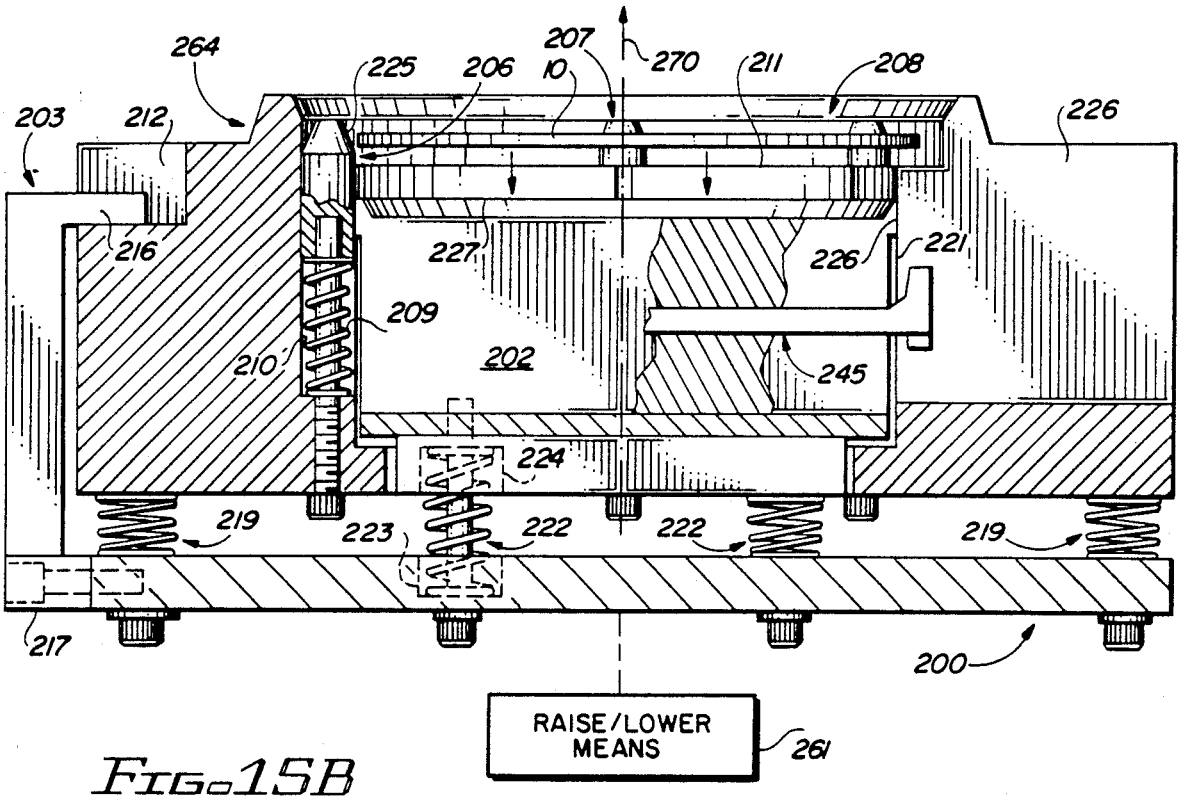

In FIG. 15B, means 262 has been activated to upwardly displace base 200 and assembly 264 in the direction of arrow 270 while dolly 236 and tongue 245 remains stationary. As shown in FIG. 11, portions of edge 10C of wafer 10 extend outwardly away from and free of contact with or support by tongue 245. When transport assembly 264 is displaced in the direction of arrow 270 in FIG. 15B, selected points of these free portions contact the tapered upper ends 225 of the six spaced apart pins extending upwardly from surface 211. Tapered ends 225 guide wafer 10 downwardly intermediate the pins onto support surface 227. While transport head assenbly 264 rises in FIG. 15B, portions of walls 221, 226 and 263 move upwardly past tongue 245. Both the distance between parallel opposed walls 226 and 263 and the area circumscribed by wall 221 are sufficient to permit tongue 245 to fit therein when transport head assembly 264 rises in the direction of arrow 270.

In FIG. 15B, tongue 245 is shown separated from wafer 10 even though wafer 10 has not completely settled onto support surface 227. This is done for the sake of clarity. Normally, wafer 10 will not be lifted and separated from stationary tongue 245 until wafer 10 is contacting support surface 227 and tongue 245 is beneath surface 227.

The transport head assembly 264 rises when means 261 applies an upward force (acting in the direction of arrow 270) against base 200. A pneumatic cylinder, hydraulic cylinder or any other mechanical, electrical, manual etc. prior art means may be utilized to raise, and lower, base 200 and transport head assembly 264.

Figure 15C:
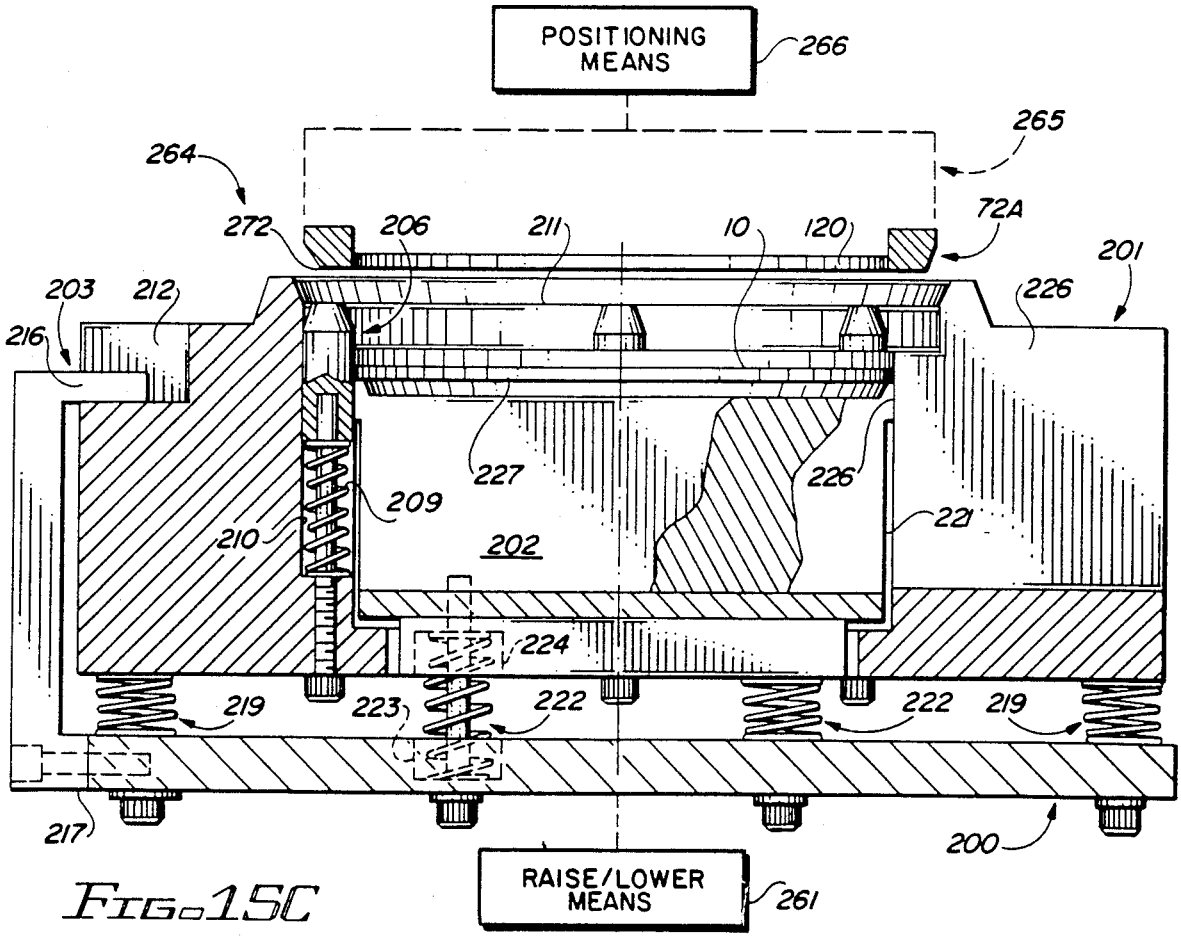
Figure 15D:
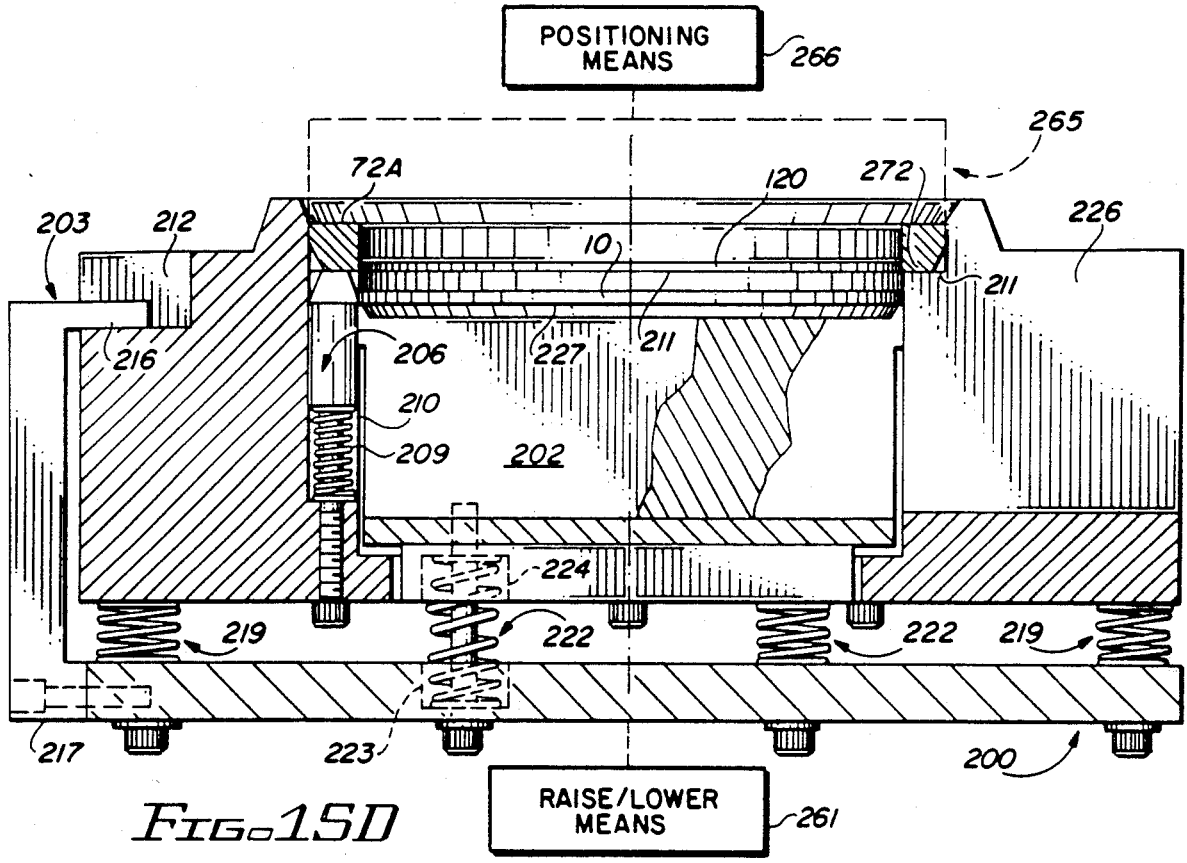
Figure 15E:
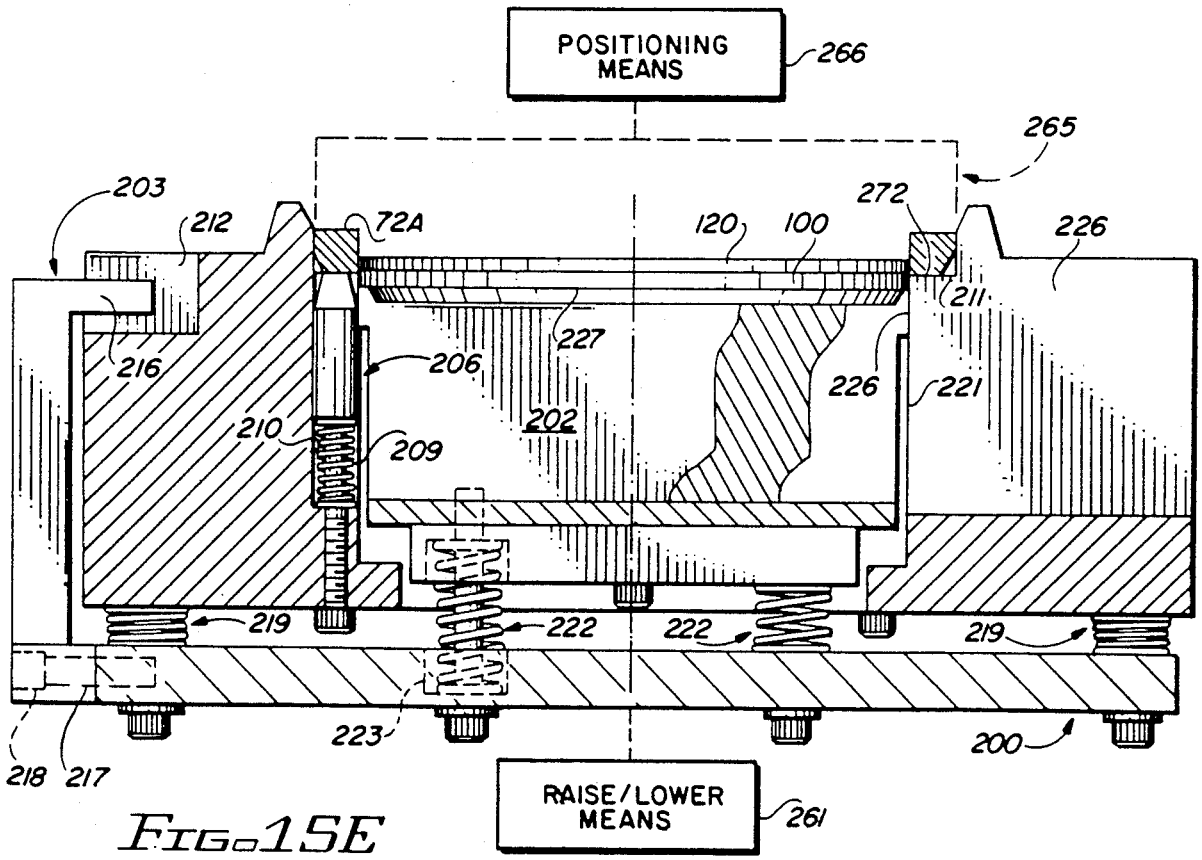

After wafer 10 is resting on circular planar support surface 227, the pressure head 265 is lowered to a position adjacent alignment cup 201. Dolly 236 can remain in fixed position or can be removed from assembly 264 in the direction of arrow 252 (FIG. 10). In FIGS. 15C to 15E, dolly 236 is assumed to have been removed from assembly 264.

After wafer 10 has settled onto support surface 227, the upward movement of transport head assembly 264 is halted and pressure head 265 is positioned adjacent alignment cup 201 in the manner illustrated in FIG. 15C. Means 266 are used to position poressure head 265 over alignment cup 201. The positioning means 266 can comprise the counterbalanced apparatus of FIG. 1 or can comprise any other appropriate prior art positioning apparatus.

When pressure head 265 is positioned adjacent alignment cup 201 illustrated in FIG. 15C, water is squirted through apertures 90 in polishing head 265 to wet wafer 10. The flow of water through apertures 90 is then discontinued and a suction is applied to apertures 90. While pressure head 265 is maintained in a fixed position, means 261 is utilized to resume the movement of base 200 and transport head assembly 264 in the direction of arrow 270. As transport head assembly 264 continues to rise, the bottom circular planar surface 272 of lip 72A contacts the six pins (including pins 206 to 208) in apertures 210. Surface 272 downwardly forces the six pins into apertures 210, compressing springs 209. The upward movement of alignment cup 201 halts when the lower circular planar surface 272 of lip 72A is contacted by circular surface 211 in the manner illustrated in FIG. 15D. After surface 211 contacts surface 272, means 261 is utilized to continue to upwardly displace base 200, compressing springs 219 and 222. While springs 219 are being compressed, pressure head 265 is maintained in fixed position, which causes alignment cup 201 to also remain in fixed position. Consequently, while base 200 continues to move upwardly and while alignment cup 201 remains stationary while springs 219 are further compressed, the continued compression of springs 222 causes piston 202 to be upwardly displaced in the direction of arrow 270 to press wafer 10 against layer 120. Once wafer 10 is positioned by piston 202 immediately adjacent or contacting layer 120, the suction through apertures 90 maintains the wafer against layer 120. FIG. 15E illustrates the position of piston 202 and springs 219, 222 after means 261 have been utilized to upwardly displace base 200 to cause piston 202 to move upwardly and press wafer 10 against layer 120. Once wafer 10 is pressed against layer 120, means 266 can be utilized to lift pressure head 265 up away from the transport head assembly and means 261 can be utilized to lower the transport head assembly back to the position of FIG. 15A. Means 266 is then utilized to move pressure head 265 to a polishing station to polish wafer 10. After the wafer 10 is polished to within selected tolerances, pressure head 265 is positioned over the water track illustrated in FIGS. 9 and 14.

Figure 9:
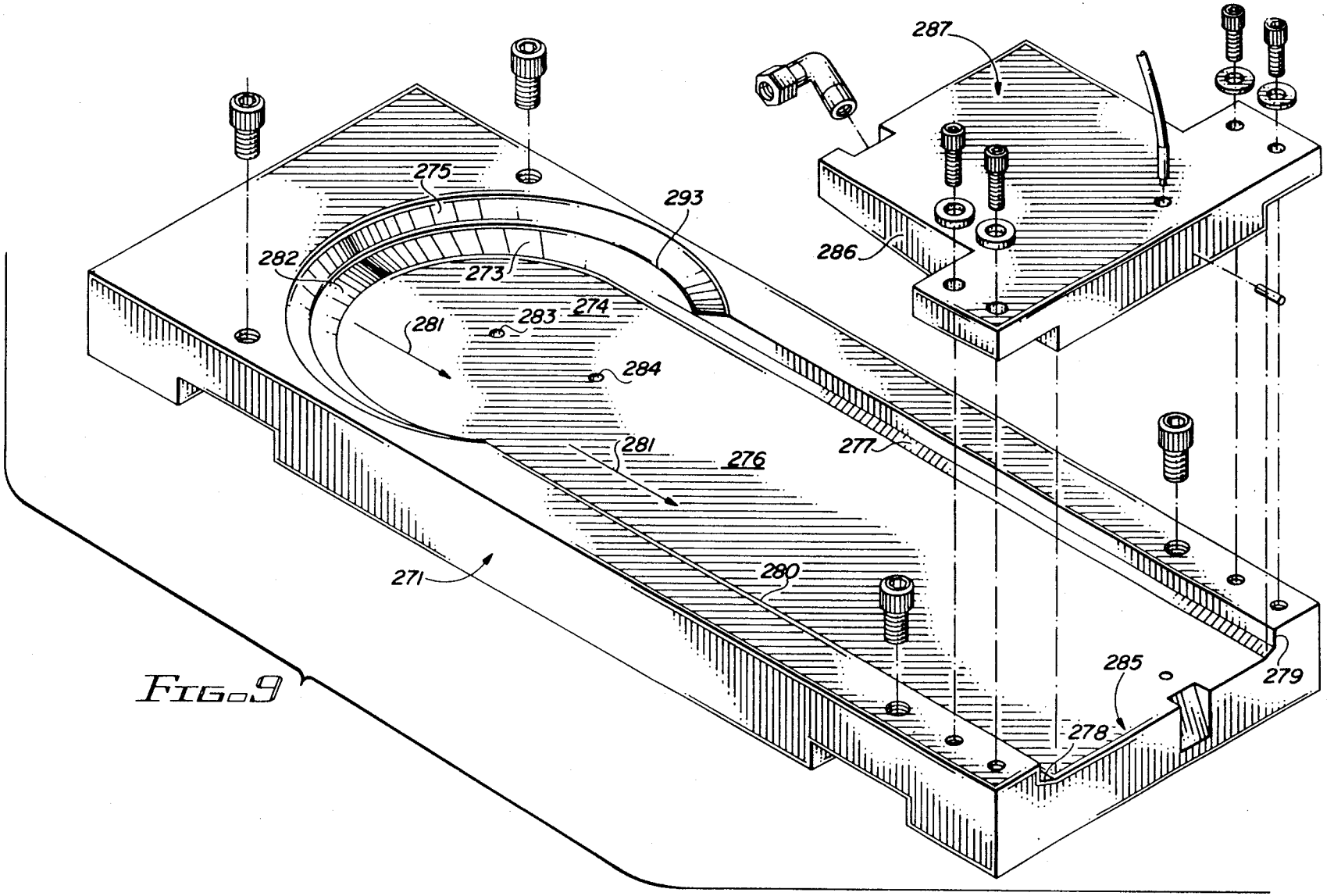
FIG. 9 is an exploded assembly view of a wafer water track assembly utilized to carry a polished wafer from the polishing head to a storage cassette.

The water track of FIGS. 9 and 11 includes an elongate rectangular housing 271 having a circular reservoir formed therein to receive a wafer ejected from pressure head 265. The wafer 10 is separated from layer 120 by discontinuing the suction through apertures 90 and by directing water flow outwardly through apertures 90. The circular reservoir in housing 271 has a floor 274 and upwardly extending outwardly sloped circular walls 273 and 275. Vertically oriented cylindrical wall 293 interconnects walls 273 and 275. An elongate channel having a floor 276 is in fluid communication with the circular reservoir. Floors 274 and 276 are co-planar. The elongate channel includes a pair of elongate, opposed spaced apart sloped side wafer-guide surfaces 277 and 278 extending upwardly and outwardly away from floor 276. Each sloped wafer-guide surface 278, 279 terminates at a vertical side wall 280 and 279, respectively. A liquid or a mixture of a liquid and gas flows into the circular reservoir and elongate channel in the direction of arrows 281 through orifice 282. Since orifice 282 injects fluid 281 to the side of the center of a wafer in the reservoir, the flow 281 of fluid imparts a rotational force on the wafer, causing it to rotate as it travels from the reservoir down the elongate channel. Gas can be included in the fluid flowing from orifice 282, or can be bubbled through apertures formed in floors 274 and 276. The admixture of gas to fluid flowing through the reservoir and channel facilitates the travel of a wafer 10 down the water track because the air bubbles function like ball bearings intermediate wafer 10 and floors 274 and 276. The lower linear circular portion 10D of edge 10C contacts sloped wall 273 while the wafer is in the circular reservoir and contacts sloped, parallel opposed walls 277 and 278 while the wafer travels down the elongate channel. Accordingly, wall 273 is sized and walls 277, 278 are spaced apart such that the bottom 10B of wafer 10 does not contact floors 274, 276 while moving down the water track. The level of water in the track is ordinarily sufficient to keep a wafer 10 in the track covered, or at least coated, with water.

When a wafer moving along the water track approaches the dispensing end 285 of the elongate channel, sloped ceiling 286 of member 287 gradually constricts the size of the channel through which water in the track can flow, tending to increase the velocity of water moving through the channel and facilitating movement of the wafer out of the dispensing end 285 into a cassette 232 positioned adjacent end 275. A stream of water directed through orifice 288 in the direction of arrow 289 flows against a wafer 10 moving through the channel toward dispensing end 285. The water imparts a downward force against the wafer 10 and also imparts a force in the direction of travel of wafer 10 which assists movement of the wafer 10 along the channel and out of end 285. The downward force produced by fluid flowing through orifice 288 is important because it prevents wafer 10 from tipping or tilting after it leaves end 285 and before the wafer 10 has moved completely into its storage slot 233A, 233B in cassette 232.

Water or other fluid flowing out of the dispensing end 285 of the water track is collected in a reservoir 290. Water from the reservoir 290 can be recycled by pump means 291 back to orifices 282, 283, 294. After a wafer 10 travels down the water track and out of dispensing end 285 into a storage slot 233A, 233B in cassette 232, means 260 lowers (or raises) cassette 232 to position another storage slot to receive a wafer 10 from the water track. When the cassette is filled, as would be the cassette in FIG. 14 after it receives a wafer 10 in slot 233A, 233B, the cassette is removed and an empty cassette installed in the reservoir.

Having described my invention in such terms as to enable those skilled in the art to understand and practice it, and having identified the presently preferred embodiments thereof, We claim:

1. Transport apparatus for transporting a wafer into position for polishing by polishing apparatus, said wafer including a peripheral edge circumscribing said wafer and including a first portion and a second portion, and spaced apart top and bottom surfaces each terminating at said edge, said polishing apparatus including at least one station having a polishing surface, a frame, elongate carrier means mounted on said frame, and a pressure head mounted on said elongate carrier means, said elongate carrier means moving said pressure head between at least two operative positions, a first operative position with said head positioned over said transport apparatus, and a second operative position with said head positioned over said station, said pressure head including a lower portion for maintaining said wafer in contact therewith and against said polishing surface when said pressure head is positioned over said station, said transport apparatus including (a) a transport head assembly;

(b) displacement means for upwardly displacing said transport head assembly;

(c) a wafer dolly having an elongate tongue to support said wafer such that said second portion of said peripheral edge extends outwardly away from and free of said tongue;

(d) means for positioning said wafer on said tongue such that said second portion of said peripheral edge extends outwardly away from and free of said tongue; and (e) means for positioning said wafer dolly with said elongate tongue extending over and in a selected position above said transport head assembly, said transport head assembly including (i) a base, (ii) an alignment cup mounted on said base and having a support surface shaped and dimensioned to receive and support said second portion of said wafer to support said wafer in a selected orientation, and a wall structure defining a central opening formed in said alignment cup intermediate and extending downwardly from said support surface and shaped and dimensioned to receive said tongue, (iii) a plurality of spaced apart upstanding pins mounted on said base for contacting said second portion to permit said wafer to slide intermediate said pins downwardly toward said support surface, said pins circumscribing said central opening and said support surface;

said central opening, support surface and pins being shaped and dimensioned such that when said tongue is in said selected operative position over said transport head assembly and said displacement means upwardly displaces said transport head assembly toward said tongue, said wafer slides intermediate said pins onto said support surface while said structure and support surface move upwardly past said tongue, and, (iv) means for upwardly displacing said support surface to position said wafer adjacent said lower portion of said pressure head when said pressure head is in said first operative position.

2. Transport apparatus for transporting a wafer into position for polishing by polishing apparatus, said wafer including a peripheral edge circumscribing said wafer and including a first portion and a second portion, and spaced apart top and bottom surfaces each terminating at said edge, said polishing apparatus including at least one station having a polishing surface, a frame, elongate carrier means mounted on said frame, and a pressure head mounted on said elongate carrier means, said elongate carrier means moving said pressure head between at least two operative positions, a first operative position with said head positioned over said transport apparatus, and a second operative position with said head positioned over said station, said pressure head including a lower portion for maintaining said wafer in contact therewith and against said polishing surface when said pressure head is positioned over said station, said transport apparatus including (a) a transport head assembly;

(b) displacement means for displacing said transport head assembly;

(c) means to support said first portion of said wafer such that said second portion of said wafer extends away from said support means;

(d) means for positioning said wafer on said tongue such that said second portion of said wafer extends outwardly away from said support means; and, (e) means for positioning said support means in a selected position above said transport head assembly, said transport head assembly including (i) a base, and (ii) a support surface mounted on said base and shaped and dimensioned to receive and support said second portion of said wafer to support said wafer in a selected orientation, said support surface being shaped and dimensioned such that when said support means is in said selected operative position over said transport head assembly and said displacement means displaces said transport head assembly toward said support means, said support surface contacts said second portion and moves said wafer away from said support means to a position adjacent said lower portion of said pressure head.

3. The apparatus of claim 2 wherein said support means includes an elongate tongue shaped and dimensioned to support said first portion such that said second portion of said peripheral edge of said wafer extends away from said support means.

4. The apparatus of claim 2 including a plurality of spaced apart upstanding pins mounted on said base for contacting said second portion of said peripheral edge of said wafer to permit said wafer to slide intermediate said pins toward said support surface.

5. The apparatus of claim 3 including a wall structure defining a central opening formed intermediate and extending downwardly from said support surface and shaped and dimensioned to receive said tongue when said displacement means displaces said transport head assembly toward said tongue.

6. The transport apparatus of claim 2 wherein said pressure head includes (a) an upper portion connected to said lower portion and having a planar surface area;

(b) a force transmitting member having an upper planar surface, a lower surface, and edge means at a periphery of said lower surface and contacting said planar surface area; and, (c) a rod mounted on said carrier means and including an upper end and a lower end with a bottom planar surface contacting said upper planar surface of said force transmitting member, said bottom planar surface of said rod including a circular peripheral edge and pressing against said upper planar surface of said force transmitting member, said pressure of said bottom surface of said rod against said upper planar surface of said force transmitting member being transmitted to said lower portion of said pressure head through said edge means to press said wafer against said polishing surface when said carrier means is in said second operative position;

said lower portion and force transmitting member moving between at least two operative positions with respect to said lower planar end of said rod, (e) a first operative position with said circular peripheral edge of said rod contacting said upper planar surface of said force transmitting member; and, (f) a second operative position with said lower portion and force transmitting member canted with respect to said flat bottom surface of said rod such that said flat bottom surface of said rod is canted away from and only contacts said upper planar surface along a portion of said circular periphery of said lower end.

7. The transport apparatus of claim 1 wherein said pressure head includes (a) an upper portion connected to said lower portion and having a planar surface area;

(b) a force transmitting member having an upper planar surface, a lower surface, and edge means at a periphery of said lower surface and contacting said planar surface area; and, (c) a rod mounted on said carrier means and including an upper end and a lower end with a bottom planar surface contacting said upper planar surface of said force transmitting member, said bottom planar surface of said rod including a circular peripheral edge and pressing against said upper planar surface of said force transmitting member, said pressure of said bottom surface of said rod against said upper planar surface of said force transmitting member being transmitted to said lower portion of said pressure head through said edge means to press said wafer against said polishing surface when said carrier means is in said first and second operative positions;

said lower portions and force transmitting member moving between at least two operative positions with respect to said lower planar end of said rod, (e) a first operative position with said circular peripheral edge of said rod contacting said upper planar surface of said force transmitting member; and, (f) a second operative position with said lower portion and force transmitting member canted with respect to said flat bottom surface of said rod such that said flat bottom surface of said rod is canted away from and only contacts said upper planar surface along a portion of said circular periphery of said lower end.

8. Transport apparatus for transporting a wafer into position for polishing by polishing apparatus, said wafer including a peripheral edge circumscribing said wafer and including a first portion and a second portion, and spaced apart top and bottom surfaces each terminating at said edge, said polishing apparatus including at least one station having a polishing surface, a frame, elongate carrier means mounted on said frame, and a pressure head mounted on said elongate carrier means, said elongate carrier means moving said pressure head between at least two operative positions, a first operative position with said head positioned over said transport apparatus, and a second operative position with said head positioned over said station, said pressure head including a lower portion for maintaining said wafer in contact therewith and against said polishing surface when said pressure head is positioned over said station, said transport apparatus including (a) a transport head assembly;

(b) a wafer dolly having an elongate tongue to support said wafer such that at least said second portion of said peripheral edge extends outwardly away from and free of said tongue;

(c) means for positioning said wafer on said tongue such that said second portion of said peripheral edge extends outwardly away from and free of said tongue;

(d) means for positioning said wafer dolly with said elongate tongue extending over and in a selected position above said transport head assembly, said transport head assembly including a support surface shaped and dimensioned to receive and support said second portion of said wafer to support said wafer in a selected orientation; and (e) means for upwardly displacing said support surface to contact and move said wafer adjacent said lower portion of said pressure head when said pressure head is in said first operative position.

* * * * *